United States Patent [19]

Blair et al.

[11] Patent Number: 4,710,061

[45] Date of Patent: Dec. 1, 1987

[54] OFFSHORE WELL APPARATUS AND METHOD

[75] Inventors: Christon R. Blair, Spring, Tex.; Kenneth B. Parker, Anchorage, Ak.

[73] Assignee: Atlantic Richfield Company, Plano, Tex.

[21] Appl. No.: 915,359

[22] Filed: Oct. 6, 1986

Related U.S. Application Data

[62] Division of Ser. No. 722,853, Apr. 12, 1985.

[51] Int. Cl.[4] ..... E02B 17/00

[52] U.S. Cl. ..... 405/195; 405/224; 166/368

[58] Field of Search ..... 405/227, 246, 232, 195, 405/196, 202, 224, 203, 204; 166/356, 357, 368, 350, 354

[56] References Cited

U.S. PATENT DOCUMENTS

| | | | |
|---|---|---|---|
| 657,980 | 9/1900 | Falcon | 405/228 X |
| 3,387,460 | 6/1968 | Morris | 405/228 |
| 3,881,549 | 5/1975 | Thomas | 166/357 |
| 4,170,186 | 10/1979 | Shaw | 405/202 X |
| 4,367,982 | 1/1983 | Hubbard | 405/202 |
| 4,430,023 | 2/1984 | Hayes et al. | 405/224 |
| 4,597,350 | 7/1986 | Mott | 405/224 X |

FOREIGN PATENT DOCUMENTS

| | | | |
|---|---|---|---|
| 0013602 | 7/1980 | European Pat. Off. | 405/228 |

*Primary Examiner*—Dennis L. Taylor

*Attorney, Agent, or Firm*—F. Lindsey Scott; James C. Fails

[57] ABSTRACT

An improvement in an offshore well having a main casing penetrating subterranean formations below the bottom of the water and protruding upwardly through the water with a wellhead affixed above the surface of the water and a boat landing connected with the main casing. The improvement comprises a plurality of at least three anchor piles driven into the bottom at respective azimuths and distances about the well with the well anchored thereto via cables, the cables running upwardly through pulleys disposed a predetermined distance, such as 15 feet, below the surface of the water so as to anchor the well against lateral forces, yet satisfy Marine Maritime Service regulations and allow maneuvering of boats about the well. Also disclosed are typical and preferred structures including sizes and the like.

5 Claims, 12 Drawing Figures

11
27
15
11
23
17
31
29
33
19
21
27

OFFSHORE WELL APPARATUS AND METHOD

This application is a division of application Ser. No. 722,853, filed Apr. 12, 1985.

FIELD OF THE INVENTION

This invention relates to offshore well structures that are self-supporting. More particularly, this invention relates to apparatus and method for saving a well that has been completed offshore in a depth of water, the apparatus and method allowing boat maneuvering around the well, yet providing self-supporting capability even in deep water.

DESCRIPTION OF THE PRIOR ART

The prior art has seen the development, at least on paper, of a wide variety of types of wellhead completions for offshore wells for producing hydrocarbonaceous materials from subterranean formations. These well completions have run the gambit from exotic well completions on the bottom of exceptionally deep water, through platforms and offshore structures; such as illustrated and described in "INTRODUCTION TO OFFSHORE STRUCTURES, DESIGN, FABRICATION, INSTALLATION", W. J. Graff, Gulf Publishing Co., Houston, Tex. 1981; to relatively easy completions in shallow water such as in Lake Maracaibo or similar shallow water of only a few tens of feet or less. The first type completions have been exotic and required very expensive transponders and the like. The second were very expensive and employed for multiple wells and large reserves. Even completing in intermediate depths has frequently required divers to go to the bottom to work on the wellhead where diving depths were feasible. On the other hand the shallow depths have been relatively simple and have not been regulated by the MMS (Marine Maritime Service) or other regulatory agencies which do not want boat maneuvering or navigation impeded unneccessarily. More frequently there is a demand for a method of saving a well that has been completed in water less than 100 feet to as much as 200 or more feet in depth. The types of recovery and types of wells drilled and completed in these depths of water are not as exotic as the offshore wells in exceptionally deep water, yet the methods of completing in the very shallow water are not satisfactory for providing self-supporting structure.

Illustrative of the prior art type completions which have been found satisfactory in these intermediate depths of water are those illustrated in the prior art of FIG. 1, as described later hereinafter.

These types of structures required exceptionally large, heavy, outside pipe to be self-supporting in intermediate depth water. Because the large pipe is so heavy, it requires boats and lift barges to do the remedial work on the well. Ordinarily, it would be much more convenient to have the well standing adjacent or included within a platform structure. However, if the well is a discovery well, the platform structure would not be available for at least a year. Consequently, the engineers resorted to the structure illustrated in FIG. 1 to save a well, prior to this invention.

From the foregoing it can be seen that the prior art has not been satisfactory in providing method or apparatus for saving an offshore well and providing a self-supporting well that is adequate for intermediate depths of water yet inexpensive enough to be economically desirable. Specifically, the prior art has required use of boats and lift barges to do any remedial work on the well, such as emplacing the large structurally adequate pipe.

SUMMARY OF THE INVENTION

Accordingly, it is an object of this invention to provide method and structure that is satisfactory for providing temporary, as well as permanent, well completion to save one or more offshore wells, while obviating the necessity to resort to boats and lift barges to perform the remedial work necessary to save the well as a self-supporting entity.

It is a particular object of this invention to provide an economical, readily emplaced apparatus and a method of completing a self-supporting well in the intermediate depths of water in an offshore well.

These and other objects will become clear from the descriptive matter hereinafter, particularly when taken in conjunction with the appended drawings.

In accordance with one embodiment of this invention, there is provided improved offshore well apparatus for an offshore well completed in a first depth of water above the bottom, the well having a main casing penetrating the subterreanean formations below the bottom and protruding upwardly through the water with the wellhead affixed above the surface of the water, the wellhead having valves and connecting tubing penetrating interiorly of the main casing to subsurface completions onto the well and a boat landing disposed about the main casing and connected to another well. The improvement is characterized by a plurality of at least three anchor piles driven about the well at respective azimuths and distances therefrom for anchoring the protruding main casing against lateral forces; a cable clamp connected with the casing at a predetermined distance below the surface of the water and supporting the plurality of at least three pulleys adapted to receive respective cables therethrough; the plurality of at least three cables connected respectively with the anchor piles and passed through the respective said pulleys on the cable clamp and pulled taut and connected with the boat landing and well so as to support the well against the lateral forces. In this way, boats can maneuver about the boat landing without becoming entangled in the cables or having their props fouled by cables because of the predetermined distance of vertical clearance before the cables traverse outwardly at that respective angles to their respective anchor piles.

In another embodiment of this invention there is provided a method of saving a well located offshore in a first depth of water comprising the steps of completing the well with the wellhead located on top of the main casing protruding above the water and having respective tubing and valves that are in fluid communication with the respective producing zones in the subterranean formations; emplacing a boat landing about the main casing; attaching first respective end of the plurality of at least three cables to the respective plurality of respective anchor piles and driving the anchor piles into the bottom at respective azimuths and distances from and disposed about the well; affixing a cable clamp on the main casing at a predetermined distance below the surface of the water and supporting three pulleys adapted for passing the cables therethrough; and running the at least three cables upwardly through respective pulleys and pulling them taut against the anchor piles so as to support the well against the lateral forces.

Also disclosed is a method of driving the anchor piles in which they are clamped to multiple segments of driving pipe with dogs that bite into steel plates that are welded onto the anchor pile and are released by releasing the tensile force and pulling on a release cable for each respective set of dogs. Driving pipe includes joined together joints of pipe that are joined with one end inserted within an adjacent end of an adjacent stand of pipe and that have a plurality of cables connecting together lugs on the respective sides of the joinder of the pipe.

DESCRIPTION OF PREFERRED EMBODIMENT(S)

While the method and apparatus of this invention may have multiple uses in fresh water or salt water applications, it will be described hereinafter with respect to use in intermediate depth water such as offshore in a saline environment in which boats will be allowed to maneuver unimpeded by laterally traversing cables near the surface.

Figure 1:
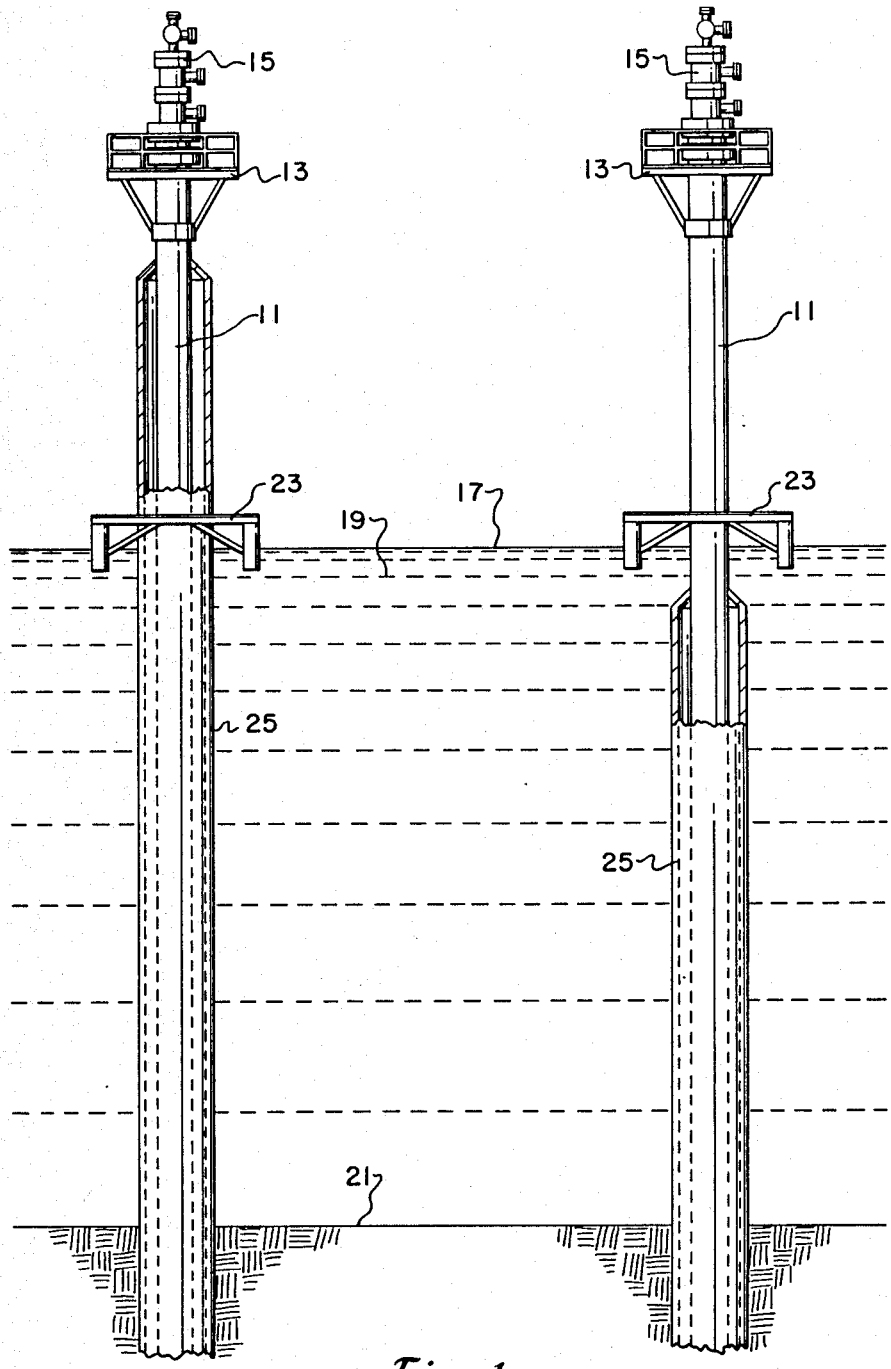
Fig. 1 Prior Art
FIG. 1 is a side elevational view, partly schematic, showing prior art apparatus.

Referring to FIG. 1, there are illustrated a couple of typical prior art installations that have been found satisfactory before this invention when the water depth is of intermediate depth in the range of from 60 to 200 feet or more of water.

The two types of completions both embody the same general principles and so will be described together. The completions employ a central or main casing 11 that supports a platform deck 13 and wellhead 15 above the surface 17 of the water 19. The water may range from 60 feet to as much as 200 feet or more above a bottom 21. These wells usually have a boat landing 23 that is supported for allowing access to the well for a variety of reasons.

The method of preserving a well completion when an individual well is drilled as illustrated has been referred to as "saving" a well. A drilling entity usually moves onto a location and drills through a well's 30 inch main casing, commonly referred to as a conductor pipe. After completion, the well is turned over to the facilities group to complete the caisson, the purpose being to have a self-supporting structure throughout its useful life. Prior to this invention, this type of supporting structure has entailed driving over the existing well a larger pipe, usually a 48 inch or 60 inch pipe with 1 to 2 inch wall thickness. This is shown in FIG. 1 by the larger pipe 25. The exact size and wall thickness is determined by an analysis performed by the structures group. As will be appreciated, such large pipe 25 is exceptionally heavy in order to create the structural integrity and allow the well to be self-supporting in intermediate depth water.

Figures 2A, 2B:
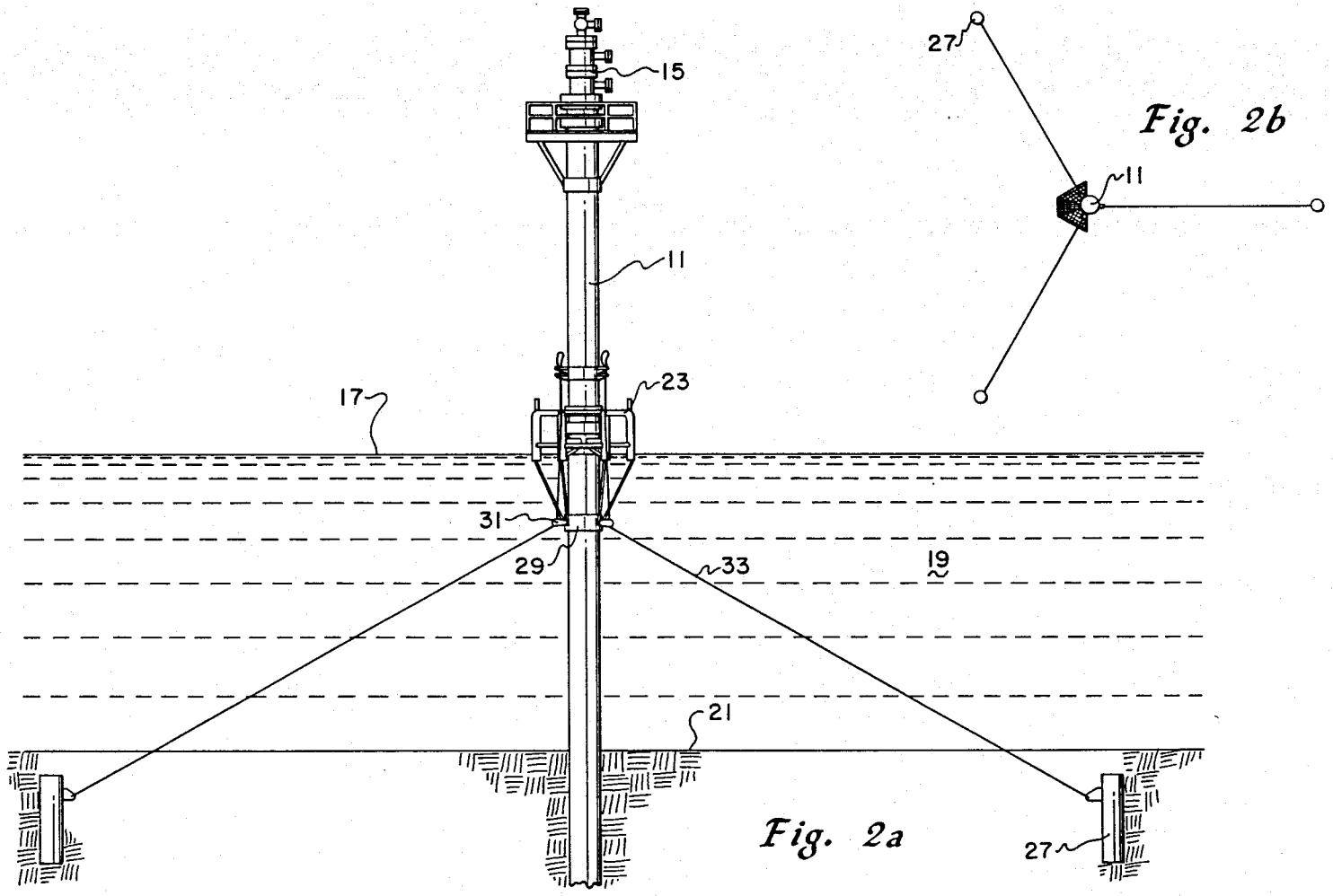
FIG. 2*a* is a side elevational view showing one embodiment of this invention.
FIG. 2*b* is a top view of the embodiment of FIG. 2*a*.

Referring to FIGS. 2*a* and 2*b* for this invention, one embodiment will be described in complete detail hereinafter. Of course in use, the sizes of the respective elements in the apparatus will vary according to the design requirements for providing adequate structural support or the like. In accordance with this invention there is provided a guyed caisson type apparatus that can be employed to develop temporary support until a jacket or deck platform system can be constructed for supporting the well or can be employed as a permanent structure useful over the life of the well.

To date, this type installation has been completed in 90 foot of water and a current designs call for completion in 150 and depths even greater than 200 feet in the future.

The well in FIGS. 2*a* and 2*b* includes the main casing 11 supporting the wellhead 15 above the surface 17 of the water 19 above the bottom 21. A boat landing 23 is emplaced on the well at the surface for accomodating a boat and one or more workmen.

The main casing 11 may comprise any suitable diameter conductor pipe. In ordinary land drilling the main casing may be thought of as analogous to a surface string. In the illustrated embodiment it is a 30 inch diameter conduit. As will be appreciated, a 30 inch diameter pipe has appreciable structural strength. Frequently, however, this is inadequate to withstand the lateral forces that could be imposed upon a well completed offshore in more than about 60 feet or so of water. Accordingly, it becomes imperative to add additional structural support against these lateral forces. The lateral forces include extraneous natural forces such as waves, wind and the like, as well as other inadvertent forces such as bumping of a boat against the boat landing and the like.

Figure 11:
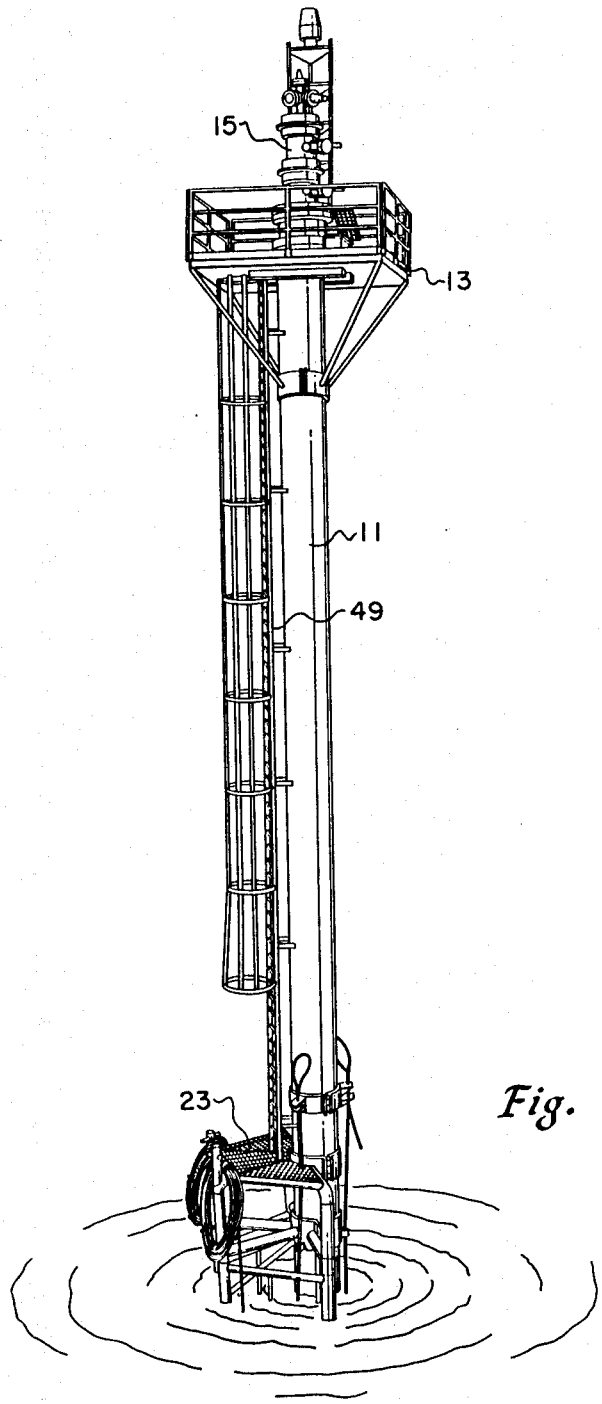
FIG. 11 is a perspective view of the final guyed caisson well completion in accordance with one embodiment of this invention.

If a platform deck 13 is employed, it will comprise the conventional type of deck for supporting a man walking about the wellhead as for interconnecting conductor pipe or the like. As illustrated in FIG. 11, the deck 13 may include guardrails and the like, in addition to an expanded metal floor or similar construction. Of course, in certain instances, the platform decks may be much larger and support production equipment such as heated treaters, separators for separating gas and liquid phases and even low temperature recovery units. Ordinarily, such elaborate production equipment will not be emplaced at a single well but at a central facility that has a large structural platform for the support of same.

The wellhead 15 will comprise any conventional types of wellhead structures including one or more high pressure valves designed to withstand the requisite fluid pressures likely to be encountered at a particular well. Each of the valves will be connected as by way of welded or bolted flange, or the like, to a tubing string that protrudes downwardly interiorly of the main casing 11 and that is completed as by packers, perforations and the like into a production zone or a particular subterranean formation that produces the fluid out of the earth through the well. All of this is conventional and need not be described in great detail herein since it will be interconnected as done conventionally.

The surface 17, the water 19 and the bottom 21 are conventional, also and may involve relatively stagnant, non-moving water, surface and bottom or may involve flowing water, such as ocean currents or bay currents.

The boat landing 23 may comprise any of the conventional types of boat landings employed. Ordinarily they are relatively small boat landings that are structurally adequate to enable off-loading any material needed to complete the well, as well as workmen to do so.

The boat landing is frequently connected with the main casing by way of suitable friction clamps or the like. By this means the boat landing can be slid upwardly or downwardly along the main casing 11. This structure is described in more detail with respect to the cable clamp 29, with which it is connected in this invention.

In accordance with this invention, there is also provided an improved structure includes a plurality of at least three anchor piles 27, a cable clamp 29 supporting the plurality of at least three pulleys 31 and the plurality of cables 33.

The anchor pile 27 may comprise any suitable form of anchor driven below the mud line. As illustrated, the anchor pile comprises 20 inch diameter anchor piles in the form of elongate sections of conduit driven below the mud level. The respective anchor piles are driven at respective distances from the well main casing 11 predetermined distances. In the illustrated embodiment, the anchor pile 27 are driven into the bottom approximately 250 feet from the well main casing 11. Of course, the distance would depend upon the depth of the water and the desired degree of support. As will be made clear hereinafter, the respective cables are preferably fastened to the respective anchor piles before the anchor piles are driven below the mud level. In the illustrated embodiment, the cables have their respective lower ends connected with the respective anchor piles by running through respective padeyes or apertures; for example, a metallic plate bracket with aperture welded onto the side of an anchor pile; before the anchor pile is driven into the bottom 21 below the mud line. In the illustrated embodiments cylindrical conduit anchor piles are employed because they are easy to drive into the bottom and because segments of large diameter conduit are readily available in the offshore area and can be economically employed, including having the bracket economically welded onto the side thereof before the cables are connected and before the anchor piles are driven into the bottom 21.

Figure 5:
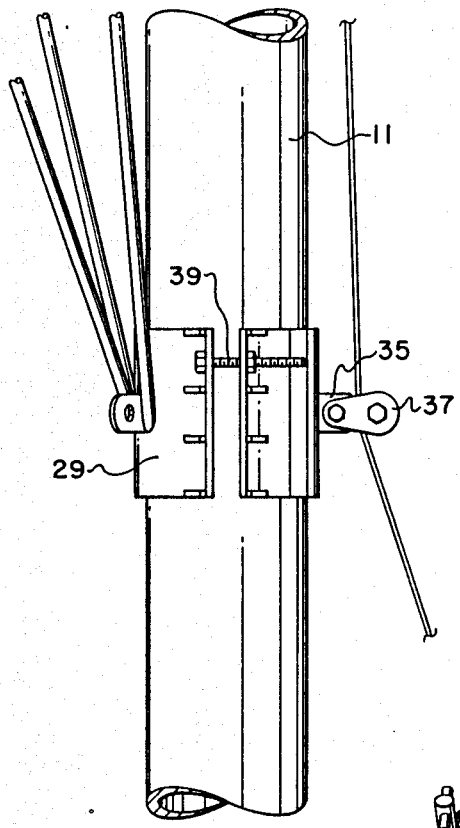
FIG. 5 is a side elevational view of the cable clamp being emplaced, showing pulleys with a cable run therethrough.

The cable clamp 29 is connected with the main casing 11 at a predetermined distance below the surface of the water and supports the plurality of at least three pulleys adapted to receive respective cables therethrough. As can be seen in FIG. 5, the cable clamp 29 comprises multiple pieces such as two pieces that have respective brackets 35 affixed thereto as by welding. The brackets, in turn, support cable pulleys 37 on their respective shafts. Ordinarily, the brackets are welded to the respective pieces of the cable clamp with the pulleys in place and the pieces of bracket are then bolted together on at least one side, as by bolts 39. Thus the pulleys are held at their predetermined depth below the surface of the water by the frictional engagement of the cable clamp with the main conduit 11.

Figure 4:
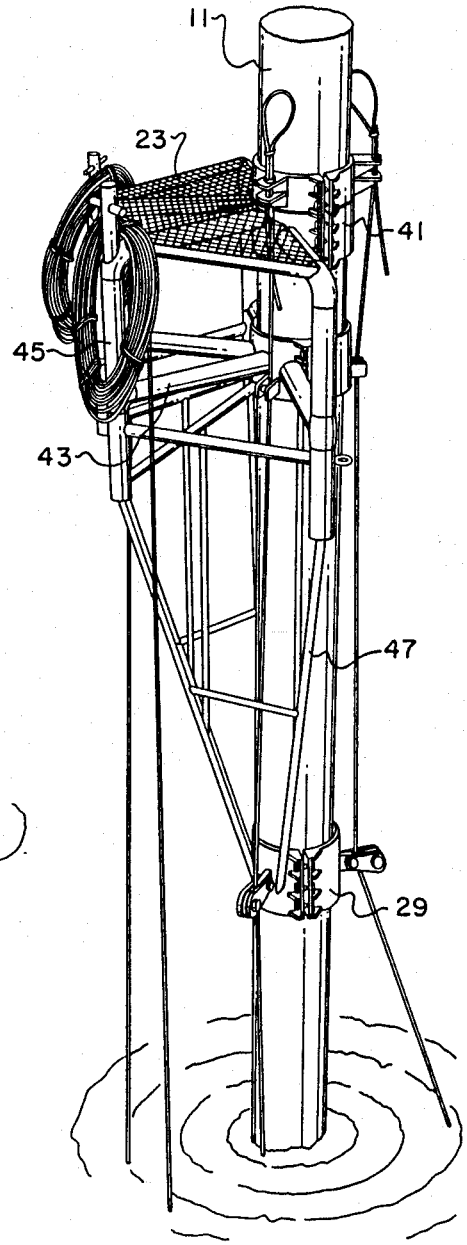
FIG. 4 is a perspective view of the boat landing with the cables being emplaced.

The cable clamp also serves as a bottom support point for a substructure for holding the boat landing in place, as can be seen in FIG. 4, before the boat landing is lowered into position on the main casing 11. The usual materials and construction such as high strength steel, non-corrosive steel or the like are employed in respective saline water environments. Of course, the materials of construction are adapted for to environment in which the respective elements will be employed.

The cables 33 will be sized in accordance with conventional engineering criteria to withstand the forces that will be imposed upon them. In the illustrated embodiment, the cables are one inch in diameter. There are three cables connected with the respective three anchor piles 27 and traverse upwardly through their respective cable pulleys 37 journalled on their respective brackets 35 affixed to the cable clamp 29. The cables are pulled taut by suitable means. For example, the usual small jackup will be provided with a small crane that can just take up the slack in the cable and pull it tight. The cable is then wrapped around and clamped off with three sets of cable clamps.

One of the advantages of employing the cable clamp as a bottom portion of a clamp assembly for the boat landing is that it is rigidly displaced with respect to the boat landing so that there is no risk of inadvertently pulling it upwardly along the main casing 11 during the tightening of the cable or otherwise. As illustrated, the boat landing 23 is connected to the main casing 11 by way of respective clamp assemblies 41. The illustrated boat landing 23 encompasses only one side of the main casing 11 in the illustrated embodiment so as to enable clamping the respective clamp assembly by their respective boats. The boat landing has an expanded metal grill floor and includes structural members 43 extending laterally from the well and engaging vertical structural members 45. The bottom of the vertical structure members 45 are then supported by a lower substructure including rods 47 that are connected with the cable clamp 29, as by being welded thereto. Thus, all of the clamp assemblies can be loosened and the boat landing lowered into place at the surface of the water and then tightened at the desired location and obviate the problem that could be encountered with varying the distance of vertical clearance. The exact design of the substructure may be varied in accordance with the structural preferences of the structural engineer doing the design work. As illustrated, the diagonal rods 47 have lateral crossbraces that are also interspersed with vertical braces for adequate structural strength and separation of the elements in the clamp assembly.

Figure 3:
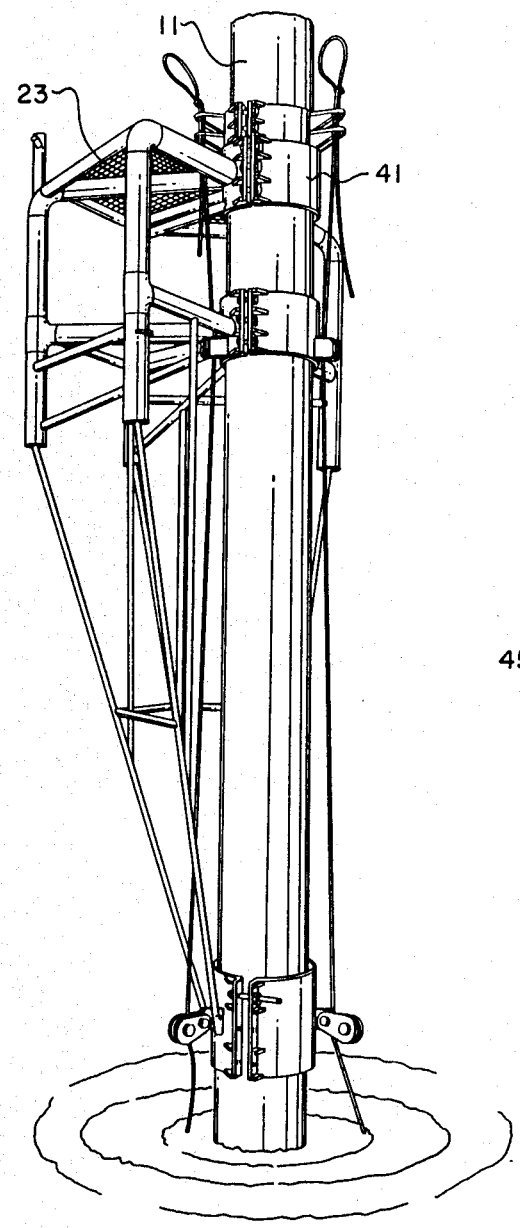
FIG. 3 is a perspective view of a boat landing being emplaced high on a main casing.
Figure 6:
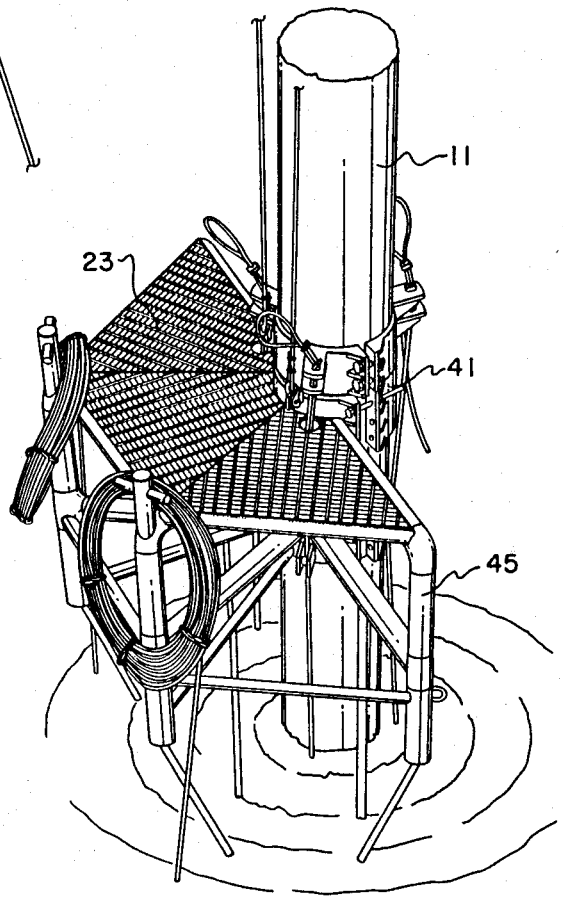
FIG. 6 is a perspective view showing the lowering of the boat landing assembly into the water downwardly along the casing.
Figure 7:
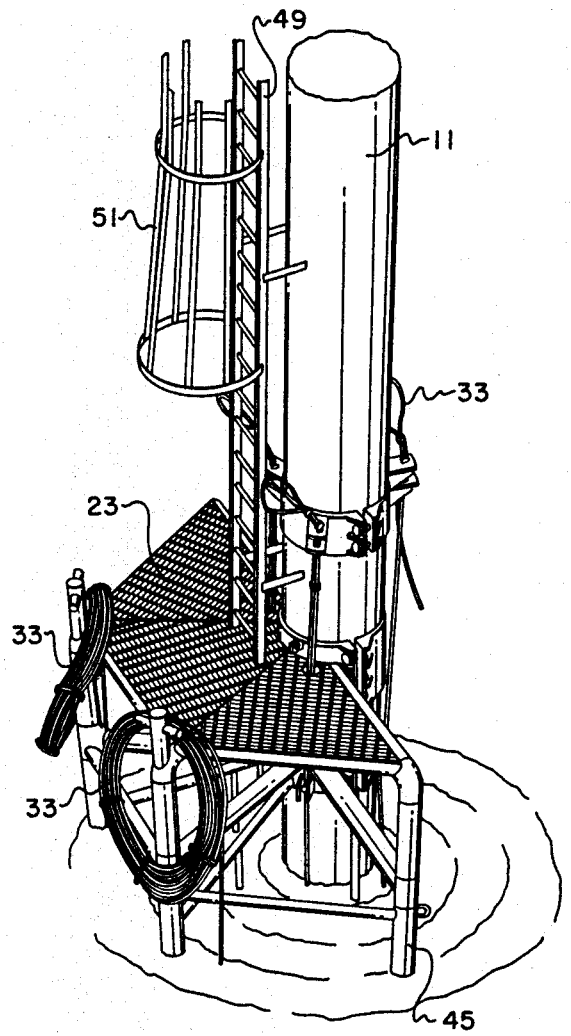
FIG. 7 is an isometric view of the boat landing installed awaiting anchoring of the final two cables in a set of three in accordance with the embodiment of FIG. 2*a*.

As can be seen in FIG. 3, the boat landing 23 is ordinarily emplaced with its respective clamp assemblies 41 high on the main casing 11. After the respective other elements are assembled together, the boat landing is lowered into the water, as illustrated in FIG. 6. Once in place, a first cable is pulled taut and then the remaining two cables are pulled taut and fastened, as illustrated in FIG. 7. In FIG. 7, a vertical ladder 49 with its enclosing safety structure 51 is affixed to the main casing 11 and affords a way for an operator to have access to the wellhead at the top of the main casing 11.

It is believed helpful to begin discussion of the method of the invention in combination with operation and combine it with a description of the elements in order to afford a complete understanding in the most economical way.

Figure 8:
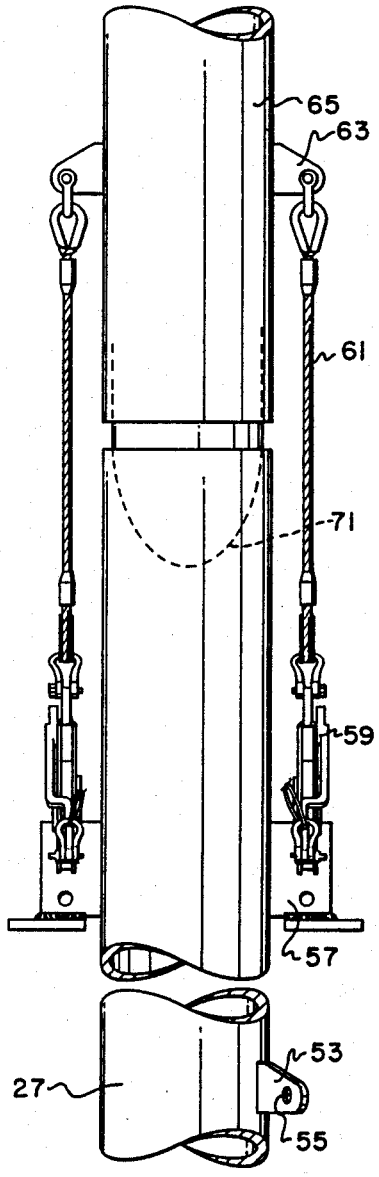
FIG. 8 is a side elevational view of one embodiment of this invention showing the holding of the anchor pile at the bottom of a drive pipe.
Figure 9:
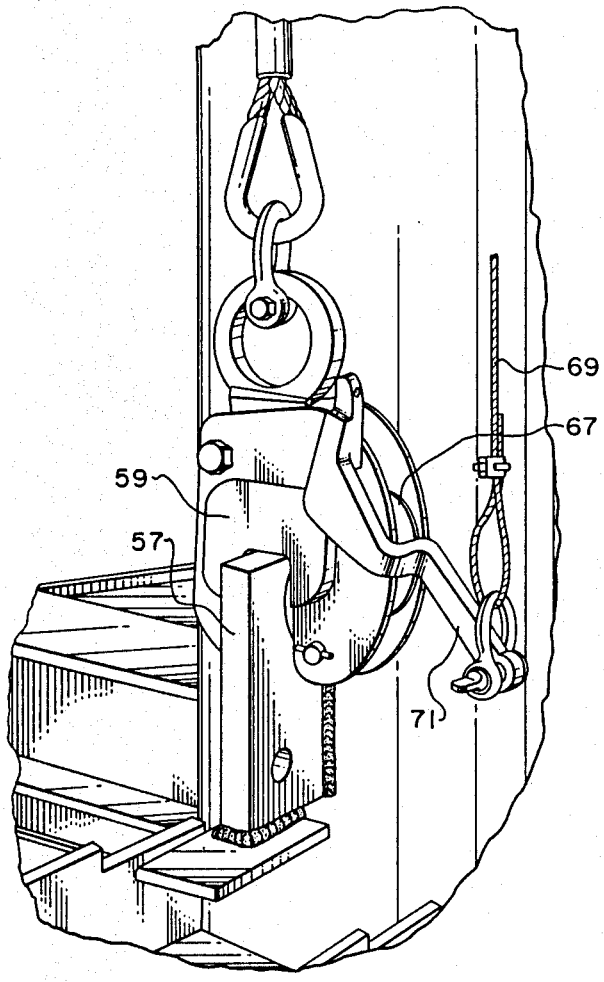
FIG. 9 is a perspective view of a clamp with the dogs clamping the steel plate of the anchor pile onto the bottom of the drive pipe.
Figure 10:
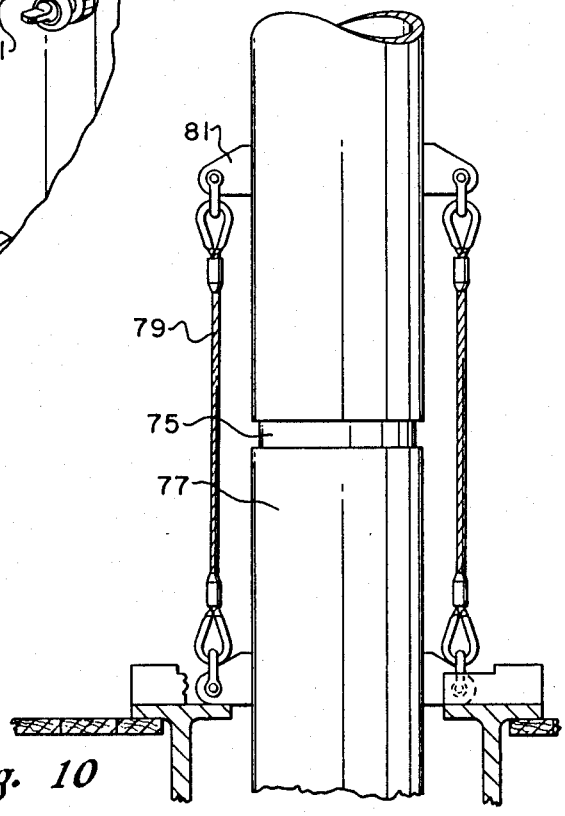
FIG. 10 is a side elevational view showing the driving pipe with multiple sections joined together.

Referring to FIG. 8, the anchor pile 27 may comprise, for example, 20 inch pipe that is 30 feet in length. A padeye 53 will be affixed, as by welding, to a side of the anchor pile for attachment of the cable. The padeye may be from 10 to 15 feet downwardly along the length of the anchor pile but is illustrated schematically in FIG. 8 simply to show the aperture 55 through which the cable 33 is threaded and fastened. The cable may be fastened by any satisfactory means, as by clamping the free end of the cable to the remainder of the cable after it has been run through the aperture 55 of the padeye 53. Any other manner of connecting that will afford a permanent connection can be employed. After the respective free ends of the cable are connected in their respective apertures 55 on their respective padeyes 53, the respective piles are driven into the bottom at the desired azimuths and distances, spaced around the well. In the illustrated in FIG. *2b* the anchor piles are driven into the bottom at about 120° intervals spaced substantially equally about the main casing 11. Of course, more anchor pile and more cables can be employed if desired. Ordinarily, however, it is advantageous to be as spartan in the use of anchor piles and cables as design will permit. It is vital, however, to use at least three in order to provide protection against lateral forces from any direction. The anchor piles are driven below the mud line because the regulatory agency such as MMS will not permit anything to be left sticking out of the mud. In order to accomplish this, the driving apparatus was designed to connect the anchor pile to driving pipe with remote release at the bottom end. As can be seen in FIG. 8, the remote release comprise plates 57 that are welded, for example, on opposite sides, of the anchor pile and are pulled upwardly by clamps 59 and cables 61 connected to respective padeyes 63 on the driving pipes 65. As illustrated, the padeyes are welded onto the sides of the driving pipe 65 in relatively the same angular position as are the plates 57 with respect to the anchor pile 27. As can be seen in FIG. 9, the respective clamps 59 include dogs 67 that clamp onto the steel plate 57 as long as tensile force is exerted. A release cable 69 enables pulling on the dog 67 to effect a release once tension has been released following the driving of the anchor pile into the bottom 21. This avoids the necessity of having to have a subsurface structure for driving the piles into the bottom. As can be seen in FIG. 8, the bottom end of the driving pipe 65 has a stabbing guide 71 to fit in the top of the anchor pile 27. Respective plates 57 are commercially available and are used in fabricating shops to haul large pieces of steel plate. The clamps 59 hold the plates 57 because of tensional weight of the anchor pile when attached to the driving pipe. When the tension is taken off after the anchor pile is driven into place, the dogs can be released with the pulling up on the release cable 69, FIG. 9, and its associated release lever 73 to release the dogs 67. Specifically, the release cable 69 is run up the side of the driving pipe to the surface so as to enable releasing the anchor pile when desired. A good time is when it is partially buried. The above system allows picking up, setting, driving and pulling off from the anchor pile without the use of any divers. Although the first emplacement was in 90 feet of water to try out the method and apparatus, a drive pipe was employed about 120 feet long. This was accomplished by using three 40 foot sections of drive pipe attached by cable as illustrated in FIG. 10. As can be seen, one end 75 is inserted within an end of the adjoining section of pipe 77. The respective sections of pipe are held together by structurally strong cables 79 connected intermediate respective padeyes 81 and are affixed, as by welding, to their respective sections of pipe at similarly configured angles.

After the piles have been driven and the cable strung up through the cable pulleys on the cable clamp 29, the cables are pulled tight by the use of a crane on the jackup boat or the like and fastened, as by clamping with three clamps. The well is then supported in place as shown in FIG. 11 with the wellhead 15 atop the main casing 11 with the platform deck 13 at the top and connected with the boat landing 23 by way of the ladder 49. The substructure beneath the surface of the water is as illustrated in FIG. *2a*.

To reiterate, the method of the invention comprises the steps of completing the well with the wellhead located on top of the main casing and connected with the interior tubing (not shown) completed in the desired completion zones. Thereafter, a boat landing is emplaced on the main casing. A first respective end of plurality of at least three cables are connected to respective plurality of anchor piles that are driven into the bottom at respective azimuths and distances about the well so as to afford the desired structural support.

A cable clamp is affixed on the main casing at a predetermined distance below the surface of the water and it supports the at least three pulleys for passing the cables through. The cables are then run upwardly through the respective pulleys and connected with the well; for example, as by connecting with the boat landing; after the cables are pulled taut against the anchor piles. Preferably, the cables are connected with the boat landing which is, in turn connected with the well so as to connect the cables with the well. Preferably, also, the cable clamp affords a bottom point of support for the clamp assembly for the boat landing 23.

The "guyed" caisson can be employed to provide temporary support until a jacket or deck platform system can be constructed about a given well completed in an offshore environment. In such an instance, the cables would then be removed and the jacket would be either stabbed with a well or set beside the well so that it could be easily attached thereto to form structural support. On the other hand, a platform could form adequate structural support. However this well structure has proven very satisfactory and may well be a permanent design offshore structure since, it has all the flexibility desired and is much more economical than the prior art approaches.

Thus it can be seen that this invention achieves all of the objects delineated hereinbefore.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. A method of saving a well located offshore in a first depth of water having a surface and above a bottom, comprising the steps of:

a. completing the well with a wellhead located on the top of a main casing protruding above the surface of the water;

b. emplacing a landing means adjacent the main casing;

c. attaching a first respective end of each of a plurality of at least three cables to said respective plurality of respective anchor piles and driving said anchor piles with the cables connected thereto into the bottom at respective azimuths and distances about the well;

d. movably affixing a plurality of clamping means on said main casing; said clamping means being movable with respect to said main casing; said clamping means including an upper clamping means and a cable clamp movably connected with said main casing a predetermined distance below said upper clamping means and at a predetermined distance below the surface of the water and supporting said plurality of at least three pulleys adapted for passing therethrough of said cables; and e. running respective said cables upwardly through respective said pulleys and connecting said cables with said well after said cables are pulled taut against said anchor piles.

2. The method of claim 1 wherein the driving of said anchor piles is effected by emplacing the anchor piles at the bottom of a driving pipe with releasable clamps and driving the anchor into the bottom releasing the releasable clamps, driving said anchor piles to desired depths; and pulling the driving pipe from over respective said anchor piles.

3. The method of claim 2 wherein said releasable clamps comprise clamps with dogs that bite into steel plate, steel plates are welded onto each said anchor pile on at least each side thereof, said dogs are caused to bite into said plates on said anchor pile; by the tensile force of supporting the anchor pile; said dogs are released by releasing the tension after said anchor pile has been driven into said bottom and pulling upwardly on a respective release cable for each respective set of dogs and clamps.

4. The method of claim 2 wherein said anchor comprises large diameter pipe; said driving pipe includes joined together joints of large-diameter pipe that are joined with one end inserted within an adjacent end of an adjacent stand of pipe and wherein a plurality of cables connect together lugs on respective sides of the joinder of the pipe, the cables and lugs being disposed around the pipe so as to hold the pipe together even against tensile forces.

5. The method of claim 1 wherein said landing means comprises a boat landing; and said cables are connect with said well via said boat landing.

* * * * *